United States Patent [19]

Kuhl

[11] Patent Number: 4,887,366

[45] Date of Patent: Dec. 19, 1989

[54] ARTICLE DRYING APPARATUS WITH ADJUSTABLE DRYING PLENUM MEANS

[76] Inventor: Henry Y. Kuhl, Kuhl Rd., P.O. Box 26, Flemington, N.J. 08822-0026

[21] Appl. No.: 207,420

[22] Filed: Jun. 16, 1988

[51] Int. Cl.[4] ..... F26B 19/00

[52] U.S. Cl. ..... 34/229; 34/233; 34/236

[58] Field of Search ..... 34/33, 34, 216, 243 C, 34/217, 229, 158, 236; 198/836

[56] References Cited

U.S. PATENT DOCUMENTS

| | | | |
|---|---|---|---|
| 2,442,475 | 6/1948 | Swanson | 15/3.13 |
| 2,588,787 | 3/1952 | Wright | 34/71 |
| 3,203,435 | 8/1965 | Kurtz | 34/158 |
| 3,224,108 | 12/1965 | Flaming | 34/217 |
| 3,349,419 | 10/1967 | Kuhl et al. | 15/31.3 |
| 3,367,040 | 2/1968 | Vani | 34/217 |
| 3,726,020 | 4/1973 | Lee, Jr. | 34/33 |
| 3,729,832 | 5/1973 | Lund | 34/34 |
| 3,771,235 | 11/1973 | Minoda et al. | 34/10 |
| 3,808,703 | 5/1974 | Kamiya | 34/243 C |
| 4,064,635 | 12/1977 | Kuhl | 34/58 |
| 4,173,831 | 11/1979 | McCord | 34/236 |
| 4,212,113 | 7/1980 | Andersson | 34/156 |
| 4,276,977 | 7/1981 | Van Kattenbroek | 198/446 |
| 4,353,455 | 10/1982 | Mumma et al. | 198/384 |
| 4,358,341 | 11/1982 | Bergquist | 159/4 B |
| 4,472,887 | 9/1984 | Avedian et al. | 34/31 |
| 4,750,277 | 6/1988 | Kuhl | 34/217 |

*Primary Examiner*—Henry A. Bennet
*Assistant Examiner*—John Sollecito
*Attorney, Agent, or Firm*—Sperry, Zoda & Kane

[57] ABSTRACT

An apparatus for drying articles having an adjustably movable drying head includes a housing having a drying chamber defined therein and a conveyor extending therethrough. The conveying means carries articles to be dried on the conveyor through the drying chamber next past adjacently positioned drying plenum devices. The plenum boxes are movably mounted with respect to the housing toward and away from the conveying means to facilitate drying of articles of different shapes and sizes. The drying plenums can be positioned to the sides of the conveyor or above or below or any combination of such positions. The drying plenums include air distribution controls such as air guides in the form of slots adapted to facilitate drying of articles by blowing of the water thereoff primarily and secondarily by evaporation. A conduit being flexible along at least a section thereof extends between the blower and the movably positioned drying heads. A device for retaining articles upon the conveyor essentially thereon is included immediately above the conveyor.

18 Claims, 2 Drawing Sheets

ARTICLE DRYING APPARATUS WITH ADJUSTABLE DRYING PLENUM MEANS

BACKGROUND OF THE INVENTION

1. Field of the Invention

The present invention deals with field of devices for processing articles carried upon a conveyor. Many various types of articles must be washed and dried in high speed operations upon a conveyor. Such articles can include baskets, buckets, trays, flats and other similarly shaped articles. The present invention provides a means for drying within such a process which is capable of being used with a great variety of differently sized articles.

Effective drying will not be achieved for small articles when the same drying height position is utilized as with larger articles. The release of drying air will be not close enough to the smaller articles in order to allow for efficient drying thereof. For this reason the present invention provides one or more movable drying heads connected by a flexible conduit means with respect to a blower means to facilitate drying of variously sized articles.

2. Description of the Prior Art

Prior art devices utilized to facilitate drying within conveyor systems include U.S. Pat. No. 2,442,475 for an Egg Washing Machine patented June 1, 1948 to O. W. Swanson; U.S. Pat. No. 2,588,787 for an Egg Drier patented Mar. 11, 1952 to F. B. Wright; U.S. Pat. No. 3,203,435 for an Egg Washing Apparatus patented Aug. 31, 1965 to J. S. Kurtz; U.S. Pat. No. 3,349,419 for Egg Washing Equipment patented Oct. 31, 1967 to H. Y. Kuhl et al; U.S. Pat. No. 3,771,235 for a Method For Floating And Drying A Web patented Nov. 13, 1973 to Minoda et al; U.S. Pat. No. 4,064,635 for an Apparatus For Drying Plastic Trays patented Dec. 27, 1977 to H. Y. Kuhl; U.S. Pat. No. 4,173,831 for an Egg Drying Apparatus patented Nov. 13, 1979 to R. C. McCord; U.S. Pat. No. 4,212,113 for an Apparatus For Drying An Air-Borne Web patented July 15, 1980 to Karl-Hugo S. Andersson; U.S. Pat. No. 4,276,977 for a Distribution And Conveyor Apparatus For Eggs patented July 7, 1981 to van Kattenbroek; U.S. Pat. No. 4,353,455 for an Article Handling Apparatus patented Oct. 12, 1982 to Mumma et al; U.S. Pat. No. 4,358,341 for a Spray Dryer patented Nov. 9, 1982 to D. H. Bergquist; and U.S. Pat. No. 4,472,887 for a System And Method For Dehydrating Produce patented Sept. 25, 1984 to Avedian et al.

SUMMARY OF THE INVENTION

The present invention provides an article drying apparatus with an adjustable drying plenum which includes a housing having a drying chamber defined therein which is adapted to receive an article for drying.

A conveyor is positioned extending in a generally horizontal direction through the housing and through the drying chamber therein to selectively transport articles for drying. A blower is adapted to supply air to the drying chamber of the housing. A drying plenum is included which may include a drying plenum positioned laterally adjacent to the drying chamber. The drying plenum includes a plenum box movably mounted with respect to the housing adjacent to the drying chamber. The plenum box defines an air inlet to receive air supplied thereto from the blower and defines an air outlet for guiding air therefrom into the drying chamber onto articles positioned therein for drying. The drying plenum can further include an air distribution control attached with respect to the plenum box adjacent the air outlet defined therein to guide the air exiting from the plenum box through the air outlet onto articles located within the drying chamber. The air distribution control means defines an air slot therein oriented obliquely with respect to the direction of conveyor movement.

The drying plenum further includes a conduit means preferably being flexible in fluid flow communication between the blower and the air inlet of the plenum to guide the air from the blower to the first air inlet of the plenum box. The first conduit is flexible in such a manner as to facilitate movable positioning of the drying plenum with respect to the housing.

The drying plenum can include one, two, three or four identically configured constructions where one can be located to each lateral side of the conveyor and one can be positioned thereabove and therebelow. The four different drying plenums can be separately and independently movable perpendicularly with respect to the direction of movement of articles on the conveyor to facilitate placement of the air dispensing device or air outlet of the plenum immediately adjacent to articles being carried to facilitate drying thereof.

An article retaining means may be positioned within the drying chamber above the conveyor in such a manner as to retain articles thereon. This article retaining device can include laterally movable members adapted to retain articles being transported in a generally central position upon the conveyor. A plenum adjustment means can be operatively secured with respect to the drying plenum for controlling adjustable positioning thereof with respect to the housing. This plenum adjustment means preferably includes a pneumatic cylinder adapted to relocate the one or more drying plenums as desired in spaced relation with respect to articles positioned within the drying chamber upon the conveyor. Furthermore, an adjustably positionable stop can be selectively fixedly secured with respect to the housing at various locations to facilitate selective positioning of each of the drying plenums with respect thereto.

It is an object of the present invention to provide an article drying apparatus with adjustable drying plenum means wherein maintenance costs are minimized.

It is an object of the present invention to provide an article drying apparatus with adjustable drying plenum means wherein efficient drying of variously sized articles is achieved.

It is an object of the present invention to provide an article drying apparatus with adjustable drying plenum means wherein initial capital cost outlay is minimized.

It is an object of the present invention to provide an article drying apparatus with adjustable drying plenum means wherein system down time is minimized.

It is an object of the present invention to provide an article drying apparatus with adjustable drying plenum means wherein pneumatically controlled cylinders can move drying heads immediately adjacent to articles carried upon the conveyor to be dried.

It is an object of the present invention to provide an article drying apparatus with adjustable drying plenum means wherein an open chain conveyor can be utilized to facilitate drying from beneath.

It is an object of the present invention to provide an article drying apparatus with adjustable drying plenum means wherein a flexible conduit is included connected between the fixedly mounted blower and the movably positionable plenum box to facilitate movability thereof.

It is an object of the present invention to provide an article drying apparatus with adjustable drying plenum means wherein article retaining means are positioned above the conveyor to hold articles being carried on the conveyor centrally thereon.

It is an object of the present invention to provide an article drying apparatus with adjustable drying plenum means wherein drying can be achieved by air dispensing nozzles positioned above, below and to the sides of articles carried upon a conveyor to be dried.

It is an object of the present invention to provide an article drying apparatus with adjustable drying plenum means wherein air dispensing slots can be used oriented obliquely with respect to the direction of movement of the articles carried upon the conveyor to be dried.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
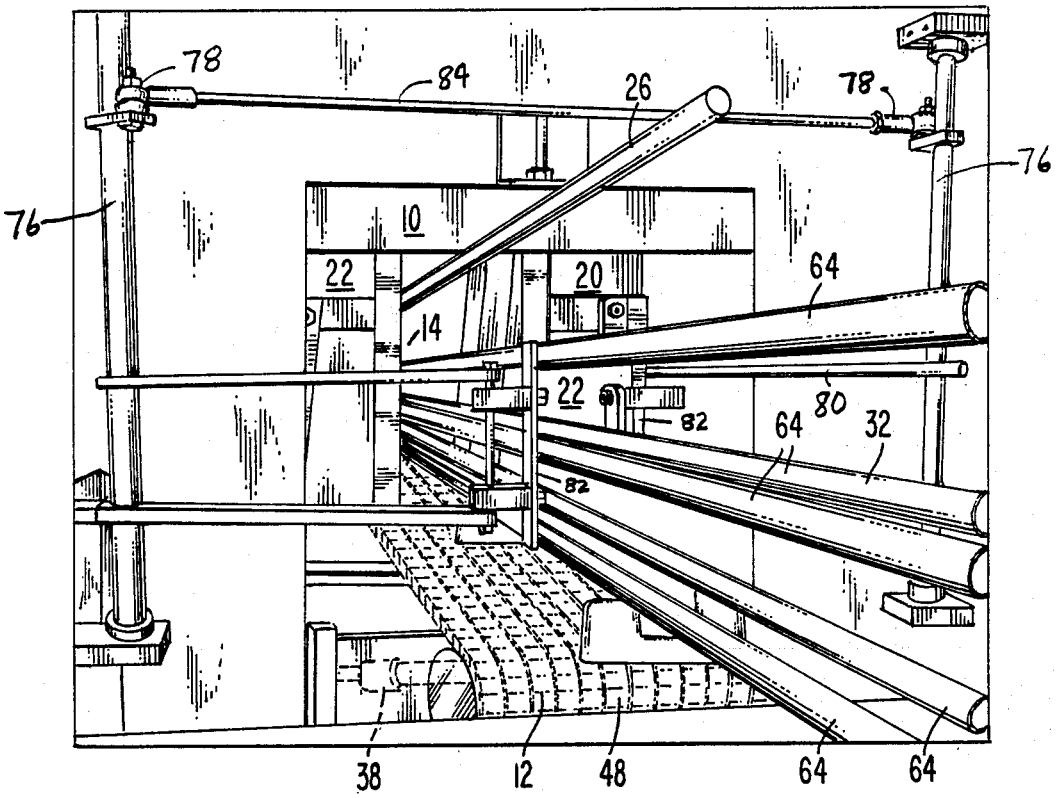
FIG. 1 is a front perspective view of an embodiment of the article carrying apparatus with adjustable drying plenum means of the present invention.
Figure 2:
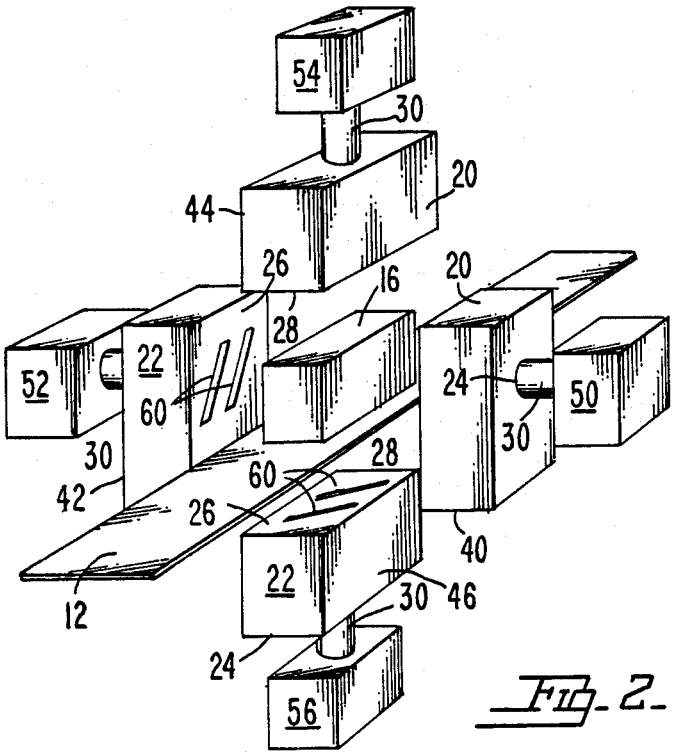
FIG. 2 is a schematic representation of the article drying apparatus of FIG. 1 shown with four drying means positioned above, below and on both sides of articles carried upon a conveyor.

The present invention provides a housing means 10 preferably fixedly secured with respect to the environmental structure. A conveyor 12 which may include an open link chain conveying surface 48 is positioned extending generally horizontally through housing 10.

A drying chamber 14 is defined within housing 10 about the conveyor 12 to facilitate the drying of articles 16 carried thereon.

Within drying chamber 14, at least one drying plenum 20 is included connected through a conduit means 30 with respect to a blower means 18. Blower 18 supplies air for drying through conduit means 30 into drying plenum 20 to facilitate drying of articles 16 carried upon conveyor 12 within drying chamber 14.

The drying plenum 20 preferably includes a plenum box 22 which is movably positionable with respect to the housing 10 and with respect to conveyor 12 in such a manner as to facilitate control of the drying operation performed upon article 16. Each plenum box 22 includes an air inlet 24 and an air outlet 26. Air outlet 26 is in fluid flow communication with respect to an air distribution control means 28 which may take the form of one or more air slots 60 to control the dispensing of air for drying.

Such air slots normally are oriented slightly obliquely with respect to the direction of movement of articles 16 positioned on conveyor 12 to minimize unwanted noise such as whines or squeals normally associated with drying of rectangular-type articles. Plenum box 22 is controlled for movement by plenum adjustment means 34 such as to be moved in closer to the conveyor when drying smaller articles and moved outwardly from the conveyor when drying larger articles.

The drying plenum 20 may include a plenum box 22 located on one or both sides of the conveyor as well as a plenum box above and/or below the conveyor. As such, there may be as many as four individual plenum boxes 22 associated with a given housing means 10. Each of the plenum boxes 22 and each plenum adjustment means 34 is generally similarly structured with a pneumatic cylinder means 38 operatively connected with respect to each plenum box 22 to facilitate movement thereof. A stop means 58 may be associated with each such plenum box to facilitate movement thereof to a specifically prechosen position by actuation of the pneumatic cylinder means 38.

Figure 3:
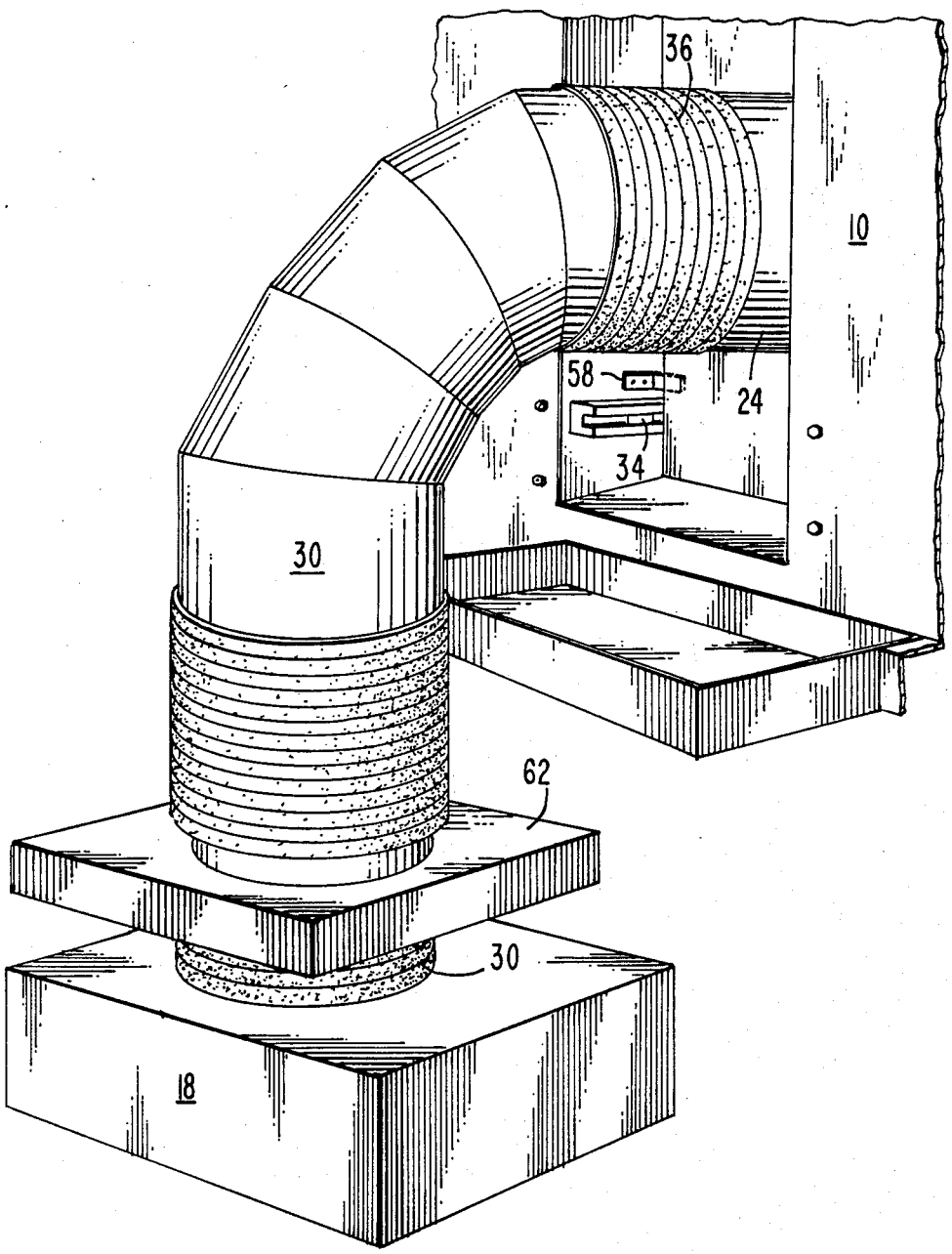
FIG. 3 is a side perspective view of an embodiment of the flexible conduit and plenum box of the present invention shown in the inward most position.

To facilitate movability of plenum boxes 22, a flexible section 36 of conduit means 30 may be included as best shown in FIG. 3. This flexible section allows movement of the box toward and away from the articles 16 upon conveyor 12 while allowing the blower 18 which may in some circumstances be fixedly mounted with respect to the surrounding environment or the housing to remain in a fixed location.

When used with multiple drying plenums, the present invention can include a first drying plenum 40 and a second drying plenum 42 positioned on lateral opposite sides of the conveyor. A third drying plenum means may be positioned above the conveyor to urge drying air downwardly thereon, and a fourth drying plenum means can be positioned below the conveyor to blow drying air upwardly through the open link chain conveying surface 48 in such a manner as to dry the articles from beneath. With this configuration, it is possible but not necessary to include a first blower 50 associated with first drying plenum 40, and a second blower 52 associated with second drying plenum 42. Furthermore, a third blower 54 can be associated with third drying plenum 44 and a fourth blower 56 can be associated with fourth drying plenum 46.

At some times, it may be desirable to dry with heated air and as such an air heating means 62 can be positioned in the fluid flow path between the blower 18 and the air distribution control means 28 as desired.

To facilitate drying, it may desirable to include an article retaining means 32 with laterally movable members 64 which are operative to retain articles 16 traveling upon conveyor 12 in the central most position upon the conveyor. That is, once the stop means 58 are adjusted such that the prechosen positions of the one or more drying plenums 40, 42, 44, and 46, are fixedly positioned then it is important that each successive article positioned upon the conveyor be in the exact orientation and lateral position. This can be achieved by laterally movable member 64 of article retaining means 32 in such a manner as to facilitate drying. Since they are laterally movable, the article retaining means 32 also can be used with a great variety of differently sized articles.

As shown in FIG. 1, the laterally movable members adapted to retain articles being transported upon the conveyor include vertical bars 76 which are adapted to rotate and are interconnected with respect to the one another by tie bar means 84. Tie bar means 84 is connected to vertical bar 76 by way of rotatable securement means such as "tie rod ends" 78. A bracket 80 is fixedly secured to each of the vertical bars 76 and a support 82 is secured to each bracket 80. Supports 82 are adapted to be secured with respect to the laterally movable bars 64 to urge them together for retaining articles therebetween positioned upon conveyor 12. In this manner rotation of a vertical bar 76 will cause simultaneous rotation of the other vertical bar 76 through the tie bar means 84. This rotation will cause the supports 82 to move toward and away from one another as necessary in order to horizontally retain an article centrally positioned upon conveyor 12.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An article drying apparatus with adjustable drying plenum means comprising:

(a) a housing means defining a drying chamber therein being adapted to receive an article for drying thereof;

(b) an open link conveying means positioned extending through said housing means and movable with respect thereto through said drying chamber to selectively transport articles for drying therethrough;

(c) a blower means adapted to supply air to said drying chamber of said housing means;

(d) a drying plenum means comprising:

(1) a first drying plenum positioned laterally adjacent said drying chamber and comprising:

(a) a first plenum box movably mounted with respect to said housing means adjacent said drying chamber defined therein, said first plenum box defining a first air inlet to receive air supplied thereto from said blower means and defining a first air outlet for guiding air therefrom into said drying chamber onto articles positioned therein for drying thereof;

(b) a first air distribution control attached with respect to said first plenum box adjacent said first air outlet defined therein to guide air exiting from said first plenum box through said first air outlet onto articles located within said drying chamber, said first air distribution control means defining a first air slot therein oriented obliquely with respect to the direction of conveyor movement;

(c) a first conduit means in fluid flow communication between said blower means and said first air inlet of said first plenum box to guide air from said blower means to said first air inlet of said first plenum box, said first conduit means being flexible to facilitate movable positioning of said first drying plenum with respect to said housing;

(2) a second drying plenum positioned laterally adjacent said drying chamber oppositely from said first drying plenum, said second drying plenum including:

(a) a second plenum box movably mounted with respect to said housing means adjacent said drying chamber defined therein, said second plenum box defining a second air inlet to receive air supplied thereto from said blower means and defining a second air outlet for guiding air therefrom into said drying chamber onto articles positioned therein for drying thereof;

(b) a second air distribution control attached with respect to said second plenum box adjacent said second air outlet defined therein to guide air exiting from said second plenum box through said second air outlet onto articles located within said drying chamber, said second air distribution control means defining a second air slot therein oriented obliquely with respect to the direction of conveyor movement;

(c) a second conduit means in fluid flow communication between said blower means and said second air inlet of said second plenum box to guide air from said blower means to said second air inlet of said second plenum box, said second conduit means being flexible to facilitate movable positioning of said second drying plenum with respect to said housing;

(3) a third drying plenum positioned adjacent said drying chamber and above said conveying means, said third drying plenum comprising:

(a) a third plenum box movably mounted with respect to said housing means adjacent said drying chamber defined therein, said third plenum box defining a third air inlet to receive air supplied thereto from said blower means and defining a third air outlet for guiding air therefrom into said drying chamber onto articles positioned therein for drying thereof;

(b) a third air distribution control attached with respect to said third plenum box adjacent said third air outlet defined therein to guide air exiting from said third plenum box through said third air outlet onto articles located within said drying chamber, said third air distribution control means defining a third air slot therein oriented obliquely with respect to the direction of conveyor movement;

(c) a third conduit means in fluid flow communication between said blower means and said third air inlet of said third plenum box to guide air from said blower means to said third air inlet of said third plenum box, said third conduit means being flexible to facilitate movable positioning of said third drying plenum with respect to said housing;

(4) a fourth drying plenum positioned adjacent said drying chamber and below said conveying means, said fourth drying plenum comprising:

(a) a fourth plenum box movably mounted with respect to said housing means adjacent said drying chamber defined therein, said fourth plenum box defining a fourth air inlet to receive air supplied thereto from said blower means and defining a fourth air outlet for guiding air therefrom into said drying chamber onto articles positioned therein for drying thereof;

(b) a fourth air distribution control attached with respect to said fourth plenum box adjacent said fourth air outlet defined therein to guide air exiting from said fourth plenum box through said fourth air outlet onto articles located within said drying chamber, said fourth air distribution control means defining a fourth air slot therein oriented obliquely with respect to the direction of conveyor movement;

(c) a fourth conduit means in fluid flow communication between said blower means and said fourth air inlet of said fourth plenum box to guide air from said blower means to said fourth air inlet of said fourth plenum box, said fourth conduit means being flexible to facilitate movable positioning of said first drying plenum with respect to said housing;

(e) article retaining means positioned within said drying chamber above said conveying means to retain articles thereupon, said article retaining means including:

(1) a first laterally movable member adapted to abut and retain articles upon said conveying means to facilitate drying thereof;

(2) a second laterally movable member adapted to abut and retaining articles upon said conveyor, said first laterally movable member and said second laterally movable member adapted to cooperate with respect to one another to retain articles therebetween upon said conveying means to facilitate drying thereof; and (f) plenum adjustment means operatively secured with respect to said plenum box means for controlling adjustable positioning thereof with respect to said housing means.

2. An article drying apparatus with adjustable drying plenum means as defined in claim 1 wherein said conduit means is flexible to facilitate movable positioning of said drying plenum means with respect to said housing.

3. An article drying apparatus with adjustable drying plenum means as defined in claim 1 wherein said conveying means extends generally horizontally through said drying chamber of said housing means.

4. An article drying apparatus with adjustable drying plenum means as defined in claim 1 wherein said plenum adjustment means includes a pneumatic cylinder means adapted to relocate said drying plenum means as desired in spaced relation with respect to articles positioned within said drying chamber upon said conveying means.

5. An article drying apparatus with adjustable drying plenum means as defined in claim 1 wherein said drying plenum means is movably mounted within said housing above said conveying means.

6. An article drying apparatus with adjustable drying plenum means as defined in claim 1 wherein said drying plenum means is movably mounted within said housing below said conveying means.

7. An article drying apparatus with adjustable drying plenum means as defined in claim 1 wherein said drying plenum means is movably mounted within said housing laterally adjacent said conveying means.

8. An article drying apparatus with adjustable drying plenum means as defined in claim 1 wherein said first drying plenum and said second drying plenum are located laterally adjacent said conveying means on opposite sides thereof.

9. An article drying apparatus with adjustable drying plenum means as defined in claim 8 wherein said third drying plenum is located above said conveying means.

10. An article drying apparatus with adjustable drying plenum means as defined in claim 9 wherein said fourth drying plenum is located below said conveying means.

11. An article drying apparatus with adjustable drying plenum means as defined in claim 1 wherein said conveying means includes an open link chain conveying surface.

12. An article drying apparatus with adjustable drying plenum means as defined in claim 1 wherein said blower means comprises a first blower in fluid flow communication with respect to said first air inlet and a second blower in fluid flow communication with respect to said second air inlet.

13. An article drying apparatus with adjustable drying plenum means as defined in claim 12 wherein said blower means further includes a third blower in fluid flow communication with respect to said third air inlet.

14. An article drying apparatus with adjustable drying plenum means as defined in claim 12 wherein said blower means further includes a fourth blower in fluid flow communication with respect to said fourth air inlet.

15. An article drying apparatus with adjustable drying plenum means as defined in claim 1 further including adjustably positionable stop means selectively fixedly securable with respect to said housing to facilitate selective positioning of said drying plenum means with respect thereto.

16. An article drying apparatus with adjustable drying plenum means as defined in claim 1 wherein said air distribution control means defines are slot therein oriented obliquely with respect to the direction of conveyor movement.

17. An article drying apparatus with adjustable drying plenum means as defined in claim 1 further including air heating means positioned within the fluid flow path between said blower means and said air distribution control means.

18. An article drying apparatus with adjustable drying plenum means comprising:

(a) a housing means defining a drying chamber therein being adapted to receive an article for drying thereof;

(b) a conveying means positioned extending generally horizontally through said housing means and movable with respect thereto through said drying chamber to selectively transport articles for drying therethrough;

(c) a blower means adapted to supply air to said drying chamber of said housing means;

(d) a drying plenum means comprising:

(1) a first drying plenum positioned laterally adjacent said drying chamber and comprising:

a. a first plenum box movably mounted with respect to said housing means adjacent said drying chamber defined therein, said first plenum box defining a first air inlet to receive air supplied thereto from said blower means and defining a first air outlet for guiding air therefrom into said drying chamber onto articles positioned therein for drying thereof;

b. a first air distribution control attached with respect to said first plenum box adjacent said first air outlet defined therein to guide air exiting from said first plenum box through said first air outlet onto articles located within said drying chamber, said first air distribution control means defining a first air slot therein oriented obliquely with respect to the direction of conveyor movement;

c. a first conduit means in fluid flow communication between said blower means and said first air inlet of said first plenum box to guide air from said blower means to said first air inlet of said first plenum box, said first conduit means being flexible to facilitate movable positioning of said first drying plenum with respect to said housing;

(2) a second drying plenum positioned laterally adjacent said drying chamber oppositely from said first drying plenum, said second drying plenum including:

a. a second plenum box movably mounted with respect to said housing means adjacent said drying chamber defined therein, said second plenum box defining a second air inlet to receive air supplied thereto from said blower means and defining a second air inlet to receive air supplied thereto from said blower means and defining a second air outlet for guiding air therefrom into said drying chamber onto articles positioned therein for drying thereof;

b. a second air distribution control attached with respect to said second plenum box adjacent said second air outlet defined therein to guide air exiting from said second plenum box through said second air outlet onto articles located within said drying chamber, said second air distribution control means defining a second air slot therein oriented obliquely with respect to the direction of conveyor movement;

c. a second conduit means in fluid flow communication between said blower means and said second air inlet of said second plenum box to guide air from said blower means to said second air inlet of said second plenum box, said second conduit means being flexible to facilitate movable positioning of said second drying plenum with respect to said housing;

(3) a third drying plenum positioned adjacent said drying chamber and above said conveying means, said third drying plenum comprising:

a. a third plenum box movably mounted with respect to said housing means adjacent said drying chamber defined therein, said third plenum box defining a third air inlet to receive air supplied thereto from said blower means and defining a third air outlet for guiding air therefrom into said drying chamber onto articles positioned therein for drying thereof;

b. a third air distribution control attached with respect to said third plenum box adjacent said third air outlet defined therein to guide air exiting from said third plenum box through said third air outlet onto articles located within said drying chamber, said third air distribution control means defining a third air slot therein oriented obliquely with respect to the direction of conveyor movement;

c. a third conduit means in fluid flow communication between said blower means and said third air inlet of said third plenum box to guide air from said blower means to said third air inlet of said third plenum box, said third conduit means being flexible to facilitate movable positioning of said third drying plenum with respect to said housing;

(4) a fourth drying plenum positioned adjacent said drying chamber and below said conveying means, said fourth drying plenum comprising:

a. a fourth plenum box movably mounted with respect to said housing means adjacent said drying chamber defined therein, said fourth plenum box defining a fourth air inlet to receive air supplied thereto from said blower means and defining a fourth air outlet for guiding air therefrom into said drying chamber onto articles positioned therein for drying thereof;

b. a fourth air distribution control attached with respect to said fourth plenum box adjacent said fourth air outlet defined therein to guide air exiting from said fourth plenum box through said fourth air outlet onto articles located within said drying chamber, said fourth air distribution control means defining a fourth air slot therein oriented obliquely with respect to the direction of conveyor movement;

c. a fourth conduit means in fluid flow communication between said blower means and said fourth air inlet of said fourth plenum box to guide air from said blower means to said fourth air inlet of said fourth plenum box, said fourth conduit means being flexible to facilitate movable positioning of said first drying plenum with respect to said housing;

e) article retaining means positioned within said drying chamber above said conveying means to retain articles thereupon, said article retaining means including laterally movable members adapted to retain articles being transported upon said conveying means;

f) plenum adjustment means operatively secured with respect to said drying plenum means for controlling adjustable positioning thereof with respect to said housing means, said plenum adjustment means including pneumatic cylinder means adapted to relocate said drying plenum means as desired in spaced relation with respect to articles positioned within said drying chamber upon said conveying means; and g) adjustably positionable stop means selectively fixedly securable with respect to said housing to facilitate selective positioning of each of said drying plenum means with respect thereto.

* * * * *

UNITED STATES PATENT AND TRADEMARK OFFICE

CERTIFICATE OF CORRECTION

PATENT NO. : 4,887,366

DATED : Dec. 19, 1989

INVENTOR(S) : Henry Y. Kuhl

It is certified that error appears in the above-identified patent and that said Letters Patent is hereby corrected as shown below:

In the Abstract, line 6, after "plenum" insert -- box --.
Column 7, line 16, "retaining" should be -- retain --.
Column 8, line 24, "are" should be -- air --.

Signed and Sealed this

Twenty-sixth Day of February, 1991

*Attest:*

HARRY F. MANBECK, JR.

*Attesting Officer*

*Commissioner of Patents and Trademarks*